US011970245B2

(12) United States Patent
Bonnaffoux et al.

(10) Patent No.: US 11,970,245 B2
(45) Date of Patent: Apr. 30, 2024

(54) YOKE PLATE ASSEMBLY FOR A MOORING ARRANGEMENT AND MOORING ARRANGEMENT COMPRISING SUCH A YOKE PLATE ASSEMBLY

(71) Applicant: SINGLE BUOY MOORINGS INC., Marly (CH)

(72) Inventors: Guillaume Bonnaffoux, Bât. Aigue Marine (MC); Morgan Ducarin, Bât. Aigue Marine (MC); Benjamin Bodot, Bât. Aigue Marine (MC)

(73) Assignee: SINGLE BUOY MOORINGS INC., Marly (CH)

( * ) Notice: Subject to any disclaimer, the term of this patent is extended or adjusted under 35 U.S.C. 154(b) by 288 days.

(21) Appl. No.: 17/415,367

(22) PCT Filed: Dec. 19, 2019

(86) PCT No.: PCT/EP2019/086392
§ 371 (c)(1),
(2) Date: Jun. 17, 2021

(87) PCT Pub. No.: WO2020/127792
PCT Pub. Date: Jun. 25, 2020

(65) Prior Publication Data

US 2022/0063767 A1 Mar. 3, 2022

(30) Foreign Application Priority Data

Dec. 19, 2018 (EP) ..... 18214106

(51) Int. Cl.
*B63B 21/04* (2006.01)
*B63B 21/20* (2006.01)
(Continued)

(52) U.S. Cl.
CPC ..... *B63B 21/04* (2013.01); *B63B 21/20* (2013.01); *B63B 21/26* (2013.01); *E02D 27/32* (2013.01); *E02D 2250/00* (2013.01)

(58) Field of Classification Search
CPC ..... B63B 21/04; B63B 21/20; B63B 21/26; B63B 21/50; B63B 21/24; E02D 27/32; E02D 2250/00; E02D 27/52
See application file for complete search history.

(56) References Cited

U.S. PATENT DOCUMENTS

| | | | |
|---|---|---|---|
| 6,688,250 | B2 | 2/2004 | Davies et al. |
| 2017/0106945 | A1 | 4/2017 | Tahar |

FOREIGN PATENT DOCUMENTS

| | | |
|---|---|---|
| CN | 108 146 580 | 6/2018 |
| FR | 2 089 011 | 1/1972 |
| WO | 2017/168141 | 10/2017 |

OTHER PUBLICATIONS

International Search Report for PCT/EP2019/086392 dated Feb. 17, 2020, 3 pages.

(Continued)

*Primary Examiner* — Anthony D Wiest
(74) *Attorney, Agent, or Firm* — NIXON & VANDERHYE

(57) ABSTRACT

A yoke plate assembly for mooring a floating object in a body of water by a pair mooring lines, includes an assembly plate mechanically coupling to an anchor body, an elongated yoke plate with a center thereof pivotally connected to the assembly plate by an articulation, a first lever arm having a first proximal end connected by a first coupler to a first end of the elongated yoke plate, a second lever arm having a second proximal end connected by a second coupler to a second end of the elongated yoke plate longitudinally opposite the first end. The first lever arm at a first distal end thereof is connectable by a first distal joint to one of the pair (Continued)

of mooring lines, and the second lever arm at a second distal end thereof is connectable by a second distal joint to the other of the pair of mooring lines.

15 Claims, 7 Drawing Sheets

(51) Int. Cl.
*B63B 21/26* (2006.01)
*E02D 27/32* (2006.01)

(56) References Cited

OTHER PUBLICATIONS

Written Opinion of the ISA for PCT/EP2019/086392 dated Feb. 17, 2020, 7 pages.

YOKE PLATE ASSEMBLY FOR A MOORING ARRANGEMENT AND MOORING ARRANGEMENT COMPRISING SUCH A YOKE PLATE ASSEMBLY

CROSS-REFERENCE TO RELATED APPLICATIONS

This application is the U.S. national phase of International Application No. PCT/EP2019/086392 filed Dec. 19, 2019 which designated the U.S. and claims priority to EP 18214106.9 filed Dec. 19, 2018, the entire contents of each of which are hereby incorporated by reference.

BACKGROUND OF THE INVENTION

Field of the Invention

The invention relates to a yoke plate assembly for mooring a floating object in a body of water. Also, the invention relates to a mooring arrangement comprising such a yoke plate assembly. Additionally, the invention relates to a floating object moored by such a mooring arrangement.

Description of the Related Art

U.S. Pat. No. 6,688,250 (Seahorse Equipment Corporation) discloses a floating platform for recovery of oil and gas from offshore oil and gas fields that supports one or more decks above the water surface to accommodate equipment for drilling and processing oil, gas and water recovered from the oil and gas field. The platform includes a central column having a portion substantially below the water surface, and including a portion which extends above the water surface. The central column includes a base node and a plurality of pontoons extending outwardly therefrom and is anchored to the seabed by one or more tendons secured to the pontoons and to the seabed.

SUMMARY OF THE INVENTION

The object is achieved by a yoke plate assembly for mooring a floating object in a body of water by means of a pair mooring lines, comprising an assembly plate for mechanically coupling to an anchor body, an elongated yoke plate with a centre thereof pivotally connected to the assembly plate by an articulation; a first lever arm having a first proximal end connected by a first coupler to a first end of the elongated yoke plate; a second lever arm having a second proximal end connected by a second coupler to a second end of the elongated yoke plate longitudinally opposite to the first end, wherein the first lever arm at a first distal end thereof is connectable by a first distal joint to one of the pair of mooring lines, and the second lever arm at a second distal end thereof is connectable by a second distal joint to the other of the pair of mooring lines.

Advantageously, the yoke plate assembly according to the invention, allows to achieve an improvement of load sharing between two mooring lines each connected at a respective end of the elongated yoke plate. The yoke plate assembly enables spreading equally tensile forces between the two mooring lines and hence divides extreme loads per a factor of two and divides the fatigue damage by a factor of eight. Additionally, the yoke plate assembly according to the invention, provides that line length differences between the two mooring lines, originating from either a difference in construction, or a difference due to the installation process, are compensated. When this is a fundamental requirement for the mooring system to perform adequately, the presence of the yoke plate assembly allows the use of conventional mooring components for the application, without going to expensive TLP tendons connectors for instance.

The application of the couplers as uni-joints advantageously allows the connection of each mooring line to articulate in two perpendicular planes, which, in case mooring chains are used, can significantly reduce out-of-plane bending fatigue.

In an embodiment, the yoke plate assembly as described above is arranged with articulation selected from a group comprising a one-axis joint, a two-axis joint, a gimbal joint, a rotary joint. Advantageously the articulation provides that the elongated yoke plate can incline due to different tensile force on each of mooring lines that can be attached to the elongated yoke plate and thus suppress large moments of force at the connections of the mooring lines on the elongated yoke plate.

In an embodiment, the invention provides a yoke plate assembly as described above, wherein the first lever arm at a first distal end thereof is connectable by a first distal joint to one of the pair of mooring lines, and the second lever arm at a second distal end thereof is connectable by a second distal joint to the other of the pair of mooring lines.

In an embodiment the invention provides a yoke plate assembly as described above, wherein the first and second coupler is a uni-joint with coplanar axes.

Advantageously, using uni-joint with coplanar axes avoids creating artificial moment loads by removing local lever arm between articulations.

In an embodiment, the invention provides a yoke plate assembly as described above, wherein the first and second lever arms each comprise a rod and a receptacle part for receiving the rod for forming a disconnectable coupling between them, in which each receptacle is connected to the respective coupler on the first end of the elongated yoke plate and the second end of the elongated yoke plate, respectively. Using a receptacle coupled to the yoke plate and a matching rod at the proximal end of the mooring line allows for a relatively simpler connection/disconnection scheme.

In an embodiment, the invention provides a yoke plate assembly as described above, wherein the joint between the first coupler and the first end of the elongated yoke plate and the first distal joint form a first elongated uni-joint, and the joint between the second coupler and the second end of the elongated yoke plate and the second distal joint form a second elongated uni-joint. The application of the couplers in combination with the lever arms as elongated uni-joints advantageously provides enhanced articulation in two planes for each mooring line to reduce out-of-plane bending fatigue.

In an embodiment, the invention provides a yoke plate assembly as described above, that further comprises a stopper mechanism for limiting an inclination angle of the elongated yoke plate relative to a surface plane of the assembly plate up to a predetermined maximum angle value.

The stopper mechanism advantageously protects the yoke plate assembly against mechanical damage in case one of the mooring lines in the pair would disconnect and the full tension would transfer to the connection of the yoke plate with other mooring line.

In addition, the invention relates to a mooring arrangement for mooring a floating object in a body of water by means of at least a pair of mooring lines attached to the floating object, to a floating object floating in a body of water, moored to the bed of the body of water by a mooring arrangement and to a method of manufacturing a yoke plate assembly.

BRIEF DESCRIPTION OF THE DRAWINGS

The invention will be explained in more detail below with reference to drawings in which illustrative embodiments thereof are shown.

DESCRIPTION OF THE PREFERRED EMBODIMENTS

Figure 1:
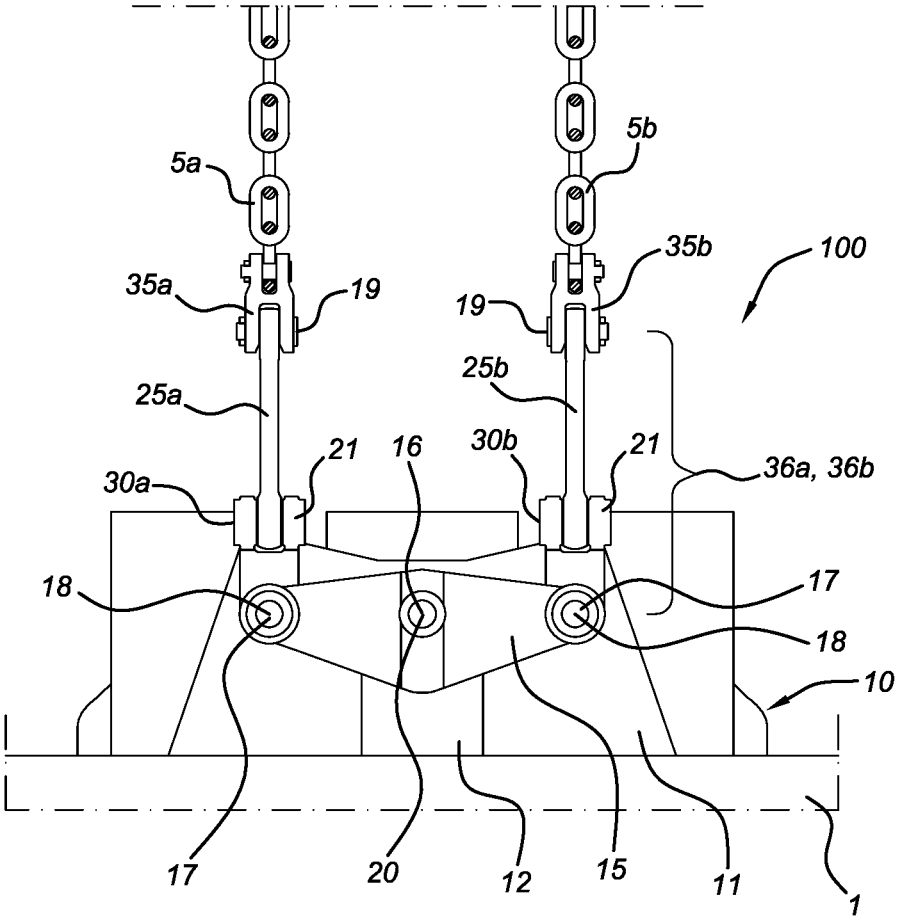
FIG. 1 shows a view in cross-section of the yoke plate assembly according to an embodiment of the invention.

The present invention will be described with respect to particular embodiments and with reference to certain drawings but the invention is not limited thereto. The drawings described are only schematic and are non-limiting. In the drawings, the size of some of the elements may be exaggerated and not drawn on scale for illustrative purposes.

FIG. 1 shows a view in cross-section of the yoke plate assembly according to an embodiment of the invention.

As shown here, the yoke plate assembly 100 is arranged on an anchor body 1 that is located on a seabed 3. Further, the yoke plate assembly 100 is coupled to a pair of mooring lines or mooring chains 5*a*, 5*b* that are attached to a floating object (not shown).

The yoke plate assembly 100 comprises an assembly plate 10, a yoke plate 15, an articulation 20, first and second lever arms 25*a*, 25*b*, first and second couplers 30*a*, 30*b* and first and second links 35*a*, 35*b*.

The yoke plate 15 consists of an elongated beam with a central articulation 20 coupled to the assembly plate 10. The central articulation 20 comprises a central axis 16 about which the yoke plate 15 can rotate for balancing the forces exerted on each of the mooring lines.

Each beam end 17 is arranged with a cylindrical opening. The cylindrical openings are configured to hold an axis of rotation 18 parallel to the central axis 16. Each axis of rotation 18 is configured to provide a pivoted coupling to a proximal end of one of the first and second lever arms 25*a*, 25*b* respectively.

Finally, each of the first and second lever arms 25*a*, 25*b* is mechanically coupled to one of the mooring lines 5*a*, 5*b*.

Advantageously, the yoke plate assembly 100 provides an enhanced load sharing between the pair of mooring lines 5*a*, 5*b*. Differences in tensile force between the mooring lines can be accommodated by a rotation about the central axis 16. Also, differences in the length of the mooring lines 5*a*, 5*b* can be compensated by a rotation of the yoke plate.

According to an embodiment, the coupling between a distal end of the lever arm and the associated mooring line is by means of a first pivoting axis 19. The coupling at the proximal end of the lever arm comprises a second pivoting axis 21. By configuring in each lever arm that the second pivoting axis 21 is perpendicular to the axis of rotation 18, an extended uni-joint 36*a*, 36*b* is formed. Advantageously, using a set-up with extended uni-joints provides a suppression of out-of-plane bending of the mooring chains during mooring by allowing perpendicular rotations around the first pivoting axis 19 and the associated axis of rotation 18.

Figure 2A:
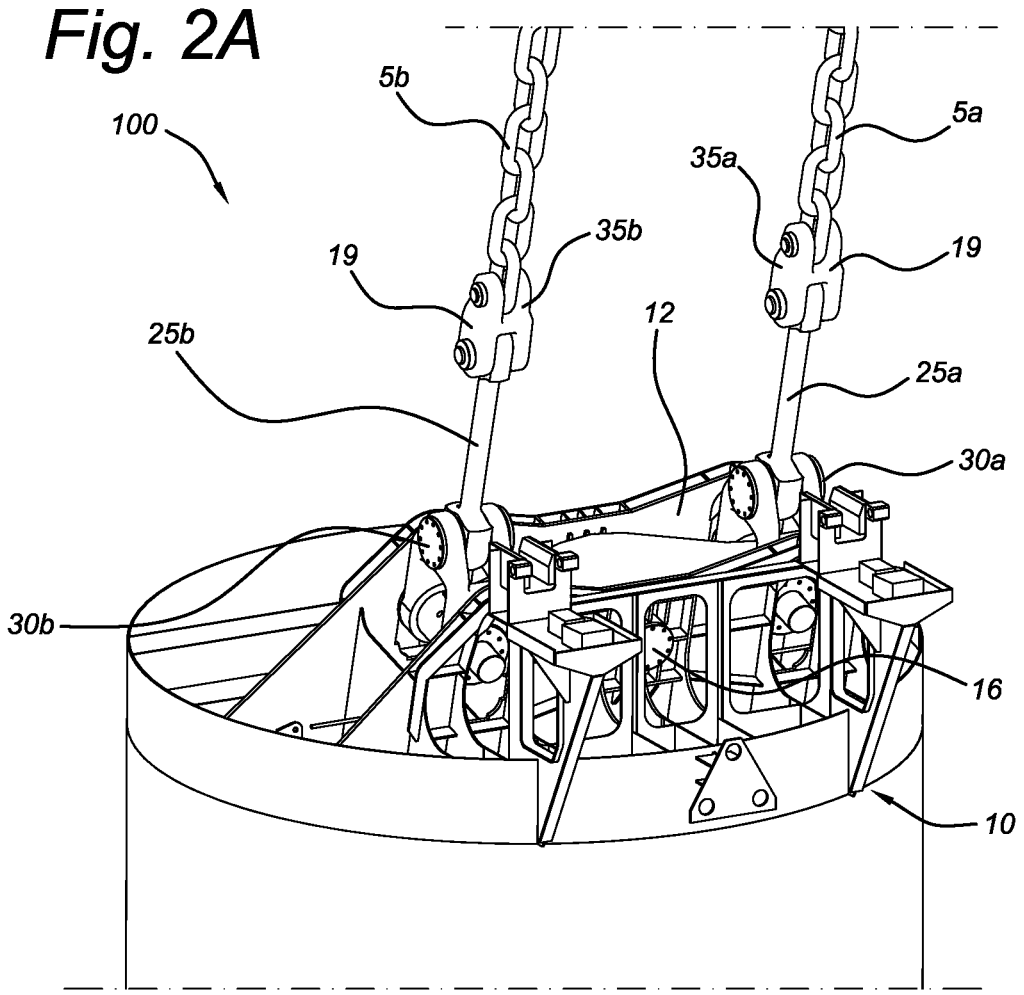
FIGS. 2A and 2B show a perspective view and a section view, respectively, of a yoke plate assembly according to an embodiment of the invention.

FIG. 2A shows a perspective view of a yoke plate assembly according to an embodiment of the invention. Within the yoke plate assembly, the yoke plate 15 is arranged in parallel between two guiding plates 11 that extend upward from the surface plane of the assembly plate 10.

The assembly plate 10 is mounted on top of the anchor body 1. According to the invention, the anchor body can be any seabed anchor type as will be appreciated by the person skilled in the art. Such anchor type includes, but is not limited to, as a gravity anchor, a suction pile, a driven pile and a hybrid anchor (i.e. a mixed structure of gravity anchor and suction pile).

Figure 2B:
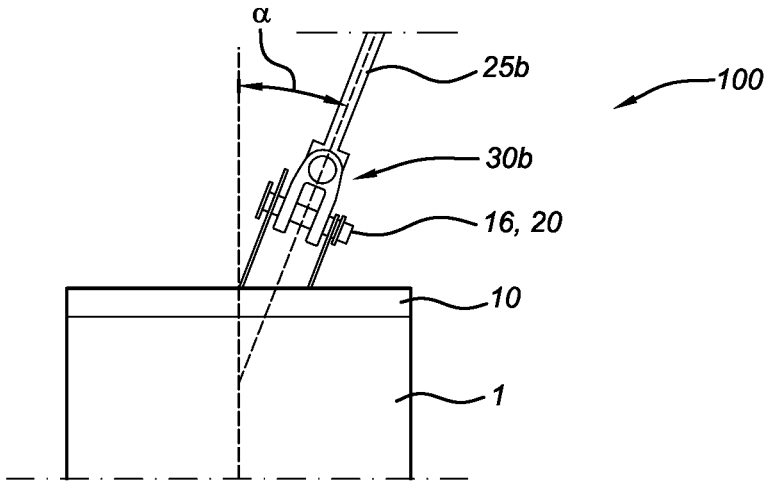

According to an embodiment, the plane of the yoke plate is under an inclination angle $\alpha$ relative to the vertical towards the floating object so that it is aligned with the inclination of the mooring line. In this manner moments of force at equilibrium position are being reduced, as depicted in FIG. 2B.

FIGS. 3*a*-3*d* show side views of a yoke plate 15 and associated articulation 20 in accordance with embodiments of the invention. According to the invention, the articulation 20 is configured to provide at least a rotation of the yoke plate relative to the surface plane 12 of the assembly plate along a central axis 16 that is parallel to the axis of rotation 18 of the couplings at the beam ends 17 of the yoke plate.

Figure 3B:
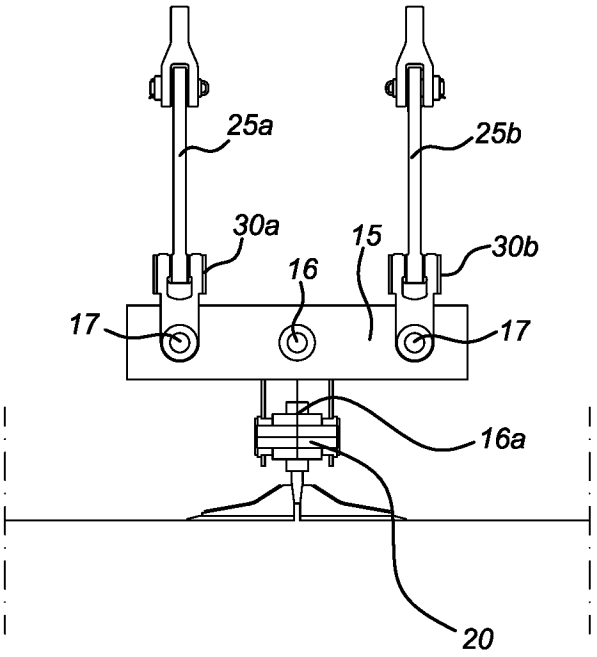
FIGS. 3*a*-3*d* show side views of a yoke plate and associated articulation in accordance with embodiments of the invention.
Figure 3A:
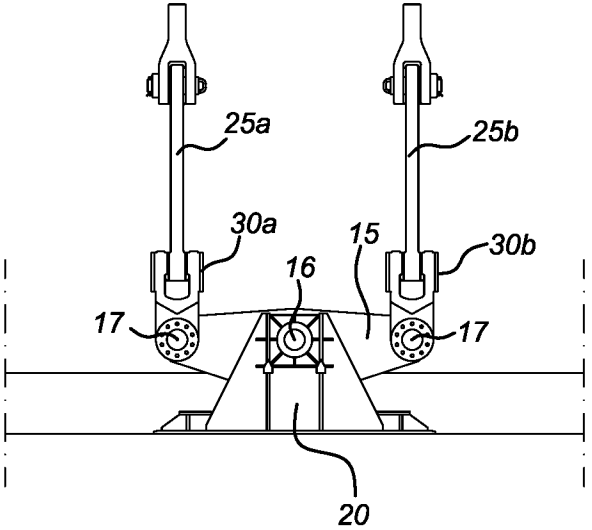

In FIG. 3*a*, a yoke plate assembly 100 is shown in which the articulation 20 is configured with the central axis 16 perpendicular to the length of the yoke plate and parallel to the surface plane 12 of the assembly plate, and with couplings at the beam ends 17 of the yoke plate that have axis of rotation 18 parallel to the central axis.

In FIG. 3*b*, a yoke plate assembly 100 is shown in which the articulation 20 comprises the central axis 16 as described above with reference to FIG. 3*a*, and a second central axis 16*a* that extends substantially perpendicular to the central axis and is parallel to the surface plane 12 of the assembly plate. In this embodiment, the articulation 20 allows that the yoke plate can incline by rotation about the second central axis 16*a*. As a result, the yoke plate assembly is capable of suppressing large moments at mooring line connections at the beam ends 17 of the yoke plate 15.

Figure 3D:
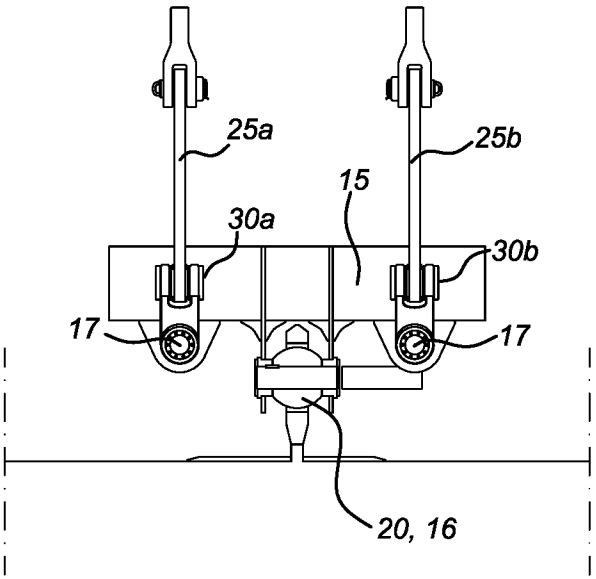
Figure 3C:
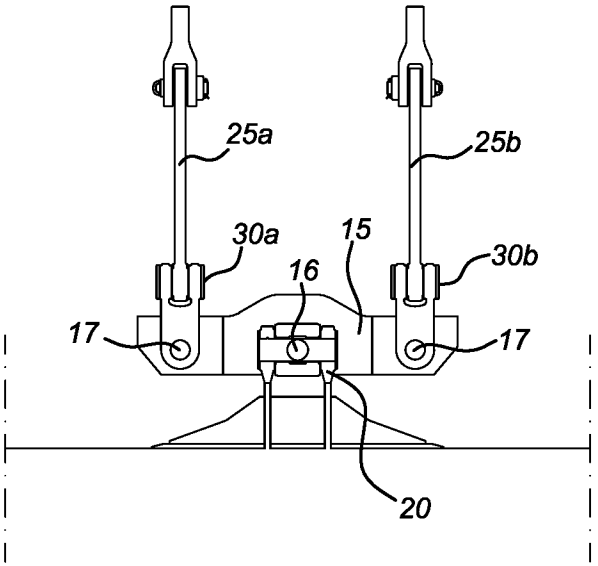

In FIG. 3*c*, a yoke plate assembly 100 is shown in which the articulation 20 comprises an arrangement of a gimbal to allow the yoke plate 15 to change its orientation relative to the surface plane 12 and to align with a (change of) direction of the mooring lines or chains 5*a*, 5*b*.

In FIG. 3*d*, a yoke plate assembly 100 is shown in which the articulation 20 comprises a rotary joint to allow the yoke plate 15 to change its orientation relative to the surface plane 12 and to align with a (change of) direction of the mooring lines.

Figure 4:
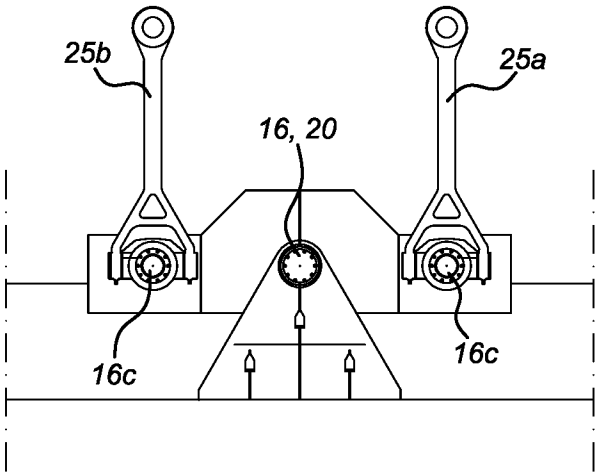
FIG. 4 shows a side view of a yoke plate assembly according to an embodiment of the invention.

FIG. 4 shows a side view of a yoke plate assembly according to an embodiment of the invention.

In this embodiment, the yoke plate assembly comprises first and second couplers 30*a*, 30*b* that are each embodied as an uni-joint with coplanar axes 16*c*, i.e., a pair of axes perpendicular to each other and rotating within the same plane (i.e., a gimbal). In such a uni-joint two coplanar articulations are integrated in a respective beam end 17 of the yoke plate 15 and are connected to the lever arms 25*a*; 25*b*. During service life this uni-joint arrangement can protect a mooring chain attached to the lever arm against damage by out-of-plane-bending.

Figure 5:
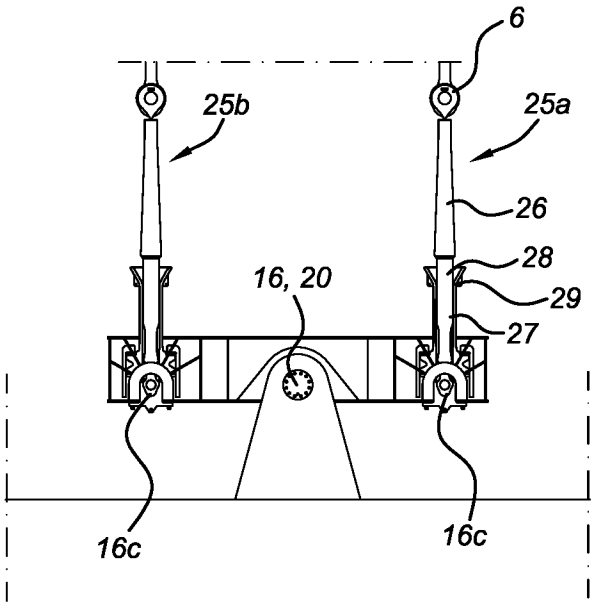
FIG. 5 shows a side view of a yoke plate assembly according to an embodiment of the invention.

FIG. 5 shows a side view of a yoke plate assembly according to an embodiment of the invention. In this embodiment, the yoke plate assembly 100 comprises first and second couplers 30*a*, 30*b* that are each embodied as an uni-joint with coplanar axes 16*c* as explained above with reference to FIG. 4. Additionally, the lever arm 25*a*; 25*b* consists of a rod 26 and a receptacle 27. The rod 26 is configured to be at the proximal end 6 of the mooring line. The receptacle 27 is coupled to the uni-joint 30*a*; 30*b* and is capable of receiving a head 28 of the rod 26: For example the receptacle 27 comprises a reversed ratchet system 29 to ensure securing the head 28 of the rod head into the receptacle 27. Thus a connectable coupling between the head 28 of the rod 26 and the receptacle 27 is formed. In each of the uni-joints, the receptacle 27 is connected to the respective coupler 30*a*; 30*b* on the corresponding beam end 17 of the elongated yoke plate 15. The connectable coupling simplifies operations of subsea connecting of mooring lines with/from the yoke plate assembly.

Figure 6:
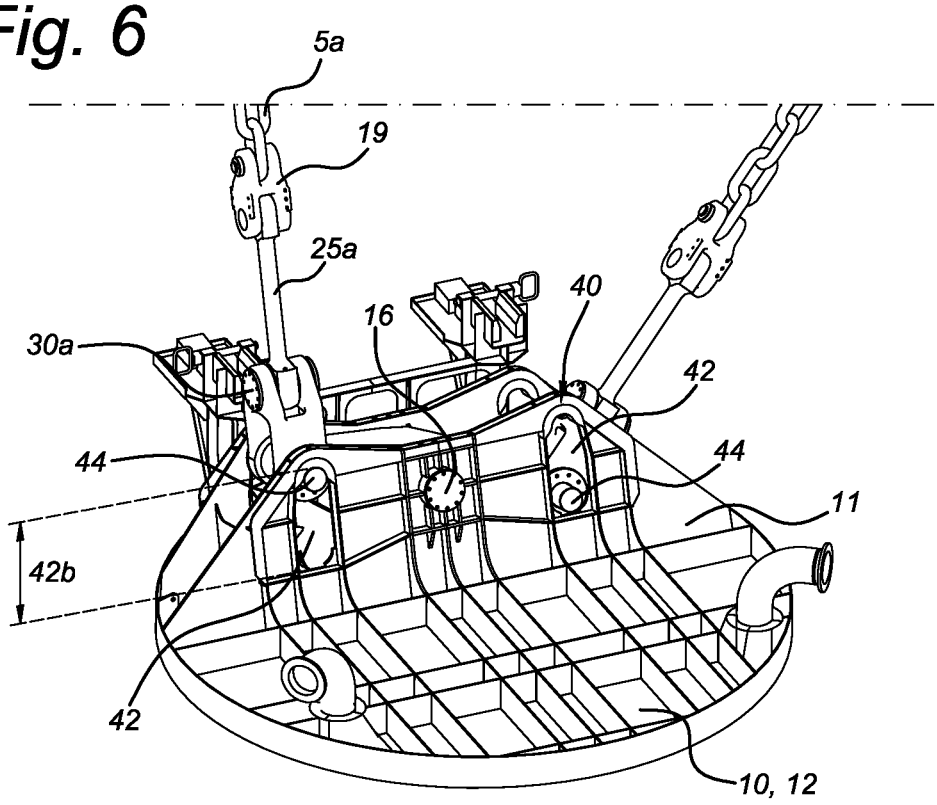
FIG. 6 shows a perspective view of a yoke plate assembly according to a further embodiment of the invention.

FIG. 6 shows a perspective view of a yoke plate assembly 100 according to a further embodiment of the invention. In this embodiment, the yoke plate assembly 100 as described in relation to the preceding figures, comprises a stopper mechanism 40 that limits the maximal inclination of the yoke plate in case of a large difference in tensile force between the mooring lines.

As shown in FIG. 6, the stopper mechanism 40 consists of two elongated slots 42 and two associated round slider pins 44. Each elongated slot 42 is arranged in at least one of the parallel guiding plates 11 at a position corresponding to a position where one of the associated slider pins 44 is attached on the yoke plate 15. Each of the slider pins 44 extends from the yoke plate 15 perpendicular to the guiding plate 11 and is inserted into the associated elongated slot 42. A rotation of the yoke plate 15 around the central axis 16 becomes limited by a length 42*b* of the elongated slots along which the slider pins can move.

An alternative stopper mechanism (not shown here) could be formed by a pair of stopper chains or lines that are coupled between the assembly plate 10 and a respective beam end 17 of the yoke plate. The length of each stopper chain or line restricts the maximal angle of rotation the yoke plate 15 can reach.

Figure 7:
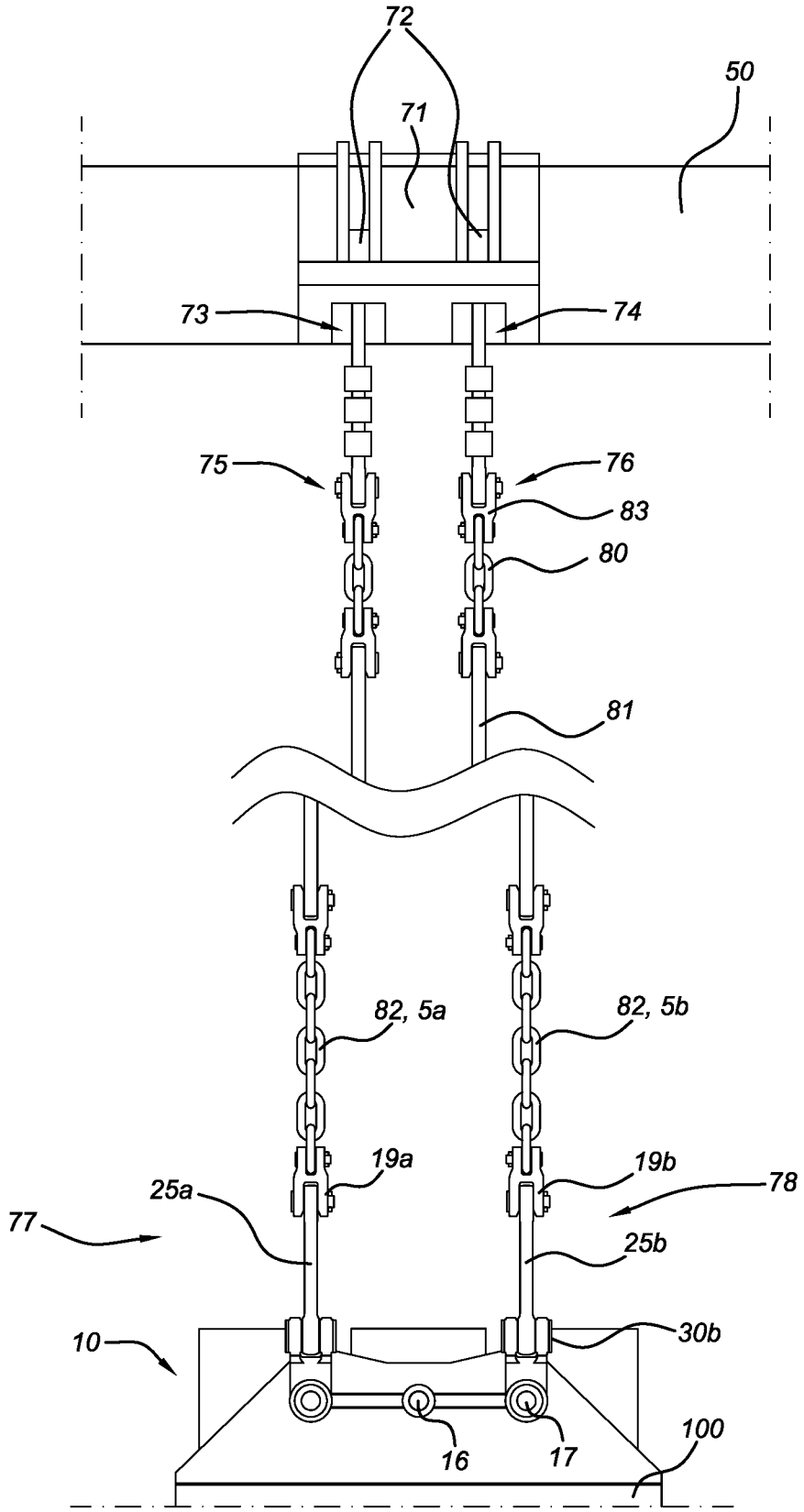
FIG. 7 shows a schematic view of a mooring arrangement comprising a floating object and a yoke plate assembly according to an embodiment of the invention.

FIG. 7 shows a schematic view of a mooring arrangement comprising a floating object 50 and a yoke plate assembly 100 according to an embodiment of the invention.

The mooring arrangement involves a floating object 50 on which a pair of mooring points 72 is arranged. Each of the mooring points 72 is configured to connect to a mooring line 73, 74 in which one mooring point connects to a proximal end 75 of a first mooring line 73 and the other mooring point connects to a proximal end 76 of a second mooring line 74. The first and second mooring lines 73, 74 form a pair of mooring lines that at their respective distal end 77, 78 connect to a respective beam end 17 of the yoke plate 15. Thus, the first and second mooring lines run in parallel between the floating object 50 and the yoke plate assembly 100. In this manner a tension leg comprising two parallel mooring lines 73, 74 can be formed.

According to a further embodiment, each of the first and second mooring lines 73, 74 comprises a proximal chain portion 80, a steel wire rope portion 81, and a distal chain portion 82, in which one end of the proximal chain portion 80 is coupled to one end of the steel wire rope portion 81 and the other end of the steel wire rope portion 81 is coupled to one end of the distal chain portion 82. The other end of the proximal chain portion 80 is coupled to the mooring point on the crossbar by means of a chain connector 83.

The other end of the distal chain portion 82 is coupled to the distal end of the lever arm 25*a*; 25*b* of the corresponding beam end 17 of the yoke plate beam 15 at the yoke plate assembly 100.

Figure 8:
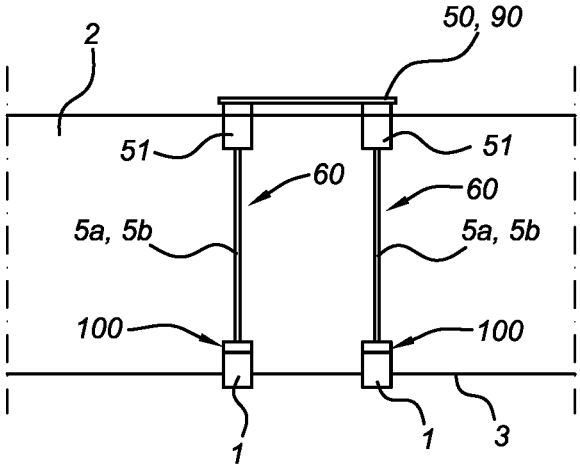
FIG. 8 shows a schematic view of a floating object moored by a mooring arrangement comprising a yoke plate assembly according to an embodiment of the invention.

FIG. 8 shows a schematic view of a floating object 50; 90 moored by a mooring arrangement 60 comprising a yoke plate assembly 100 according to an embodiment of the invention.

A floating object 50; 90 floating on a sea 2, is coupled at each of its mooring points 51 to an associated yoke plate assembly 100. At each mooring point 51 the floating object 50; 90 is coupled to a corresponding beam end 17 of the yoke plate 15 of the yoke plate assembly 100 by a pair of mooring lines or mooring chains 5*a*, 5*b*. The mooring line may be constructed in a same manner as described above with reference to FIG. 7.

Each yoke plate assembly is attached by its assembly plate 10 to a corresponding anchor body 1 that is placed at the seabed 3.

The floating object 50; 90 can be arranged as tension leg platform (TLP), or have a TLP configuration, by tensioning the mooring chains 5*a*, 5*b* between the mooring points 51 and the anchor body 1. The yoke plate assembly according to the invention allows that conventional mooring components such as mooring chains can be used. Advantageously, the mooring arrangement according to the invention can significantly reduce costs in comparison with traditional TLP that require custom-made and expensive tendon connectors to balance loads between tendons.

In an embodiment, the floating object 50; 90 comprises a construction having a wind turbine mounted on a floating frame equipped with buoyancy tanks provided with mooring points.

The invention has been described with reference to some embodiments. Obvious modifications and alterations will occur to the skilled person upon reading and understanding the preceding detailed description. It is intended that the invention be construed as including all such modifications and alterations insofar as they come within the scope of the appended claims.

The invention claimed is:

1. A yoke plate assembly for mooring a floating object in a body of water by means of a pair of mooring lines, comprising:

an assembly plate configured to be mechanically coupled to an anchor body;

an elongated yoke plate, a center thereof pivotally connected to the assembly plate by an articulation;

a first lever arm having a first proximal end connected by a first coupler to a first end of the elongated yoke plate; and a second lever arm having a second proximal end connected by a second coupler to a second end of the elongated yoke plate longitudinally opposite to the first end, wherein the first lever arm at a first distal end thereof is connectable by a first distal joint to one of the pair of mooring lines, and the second lever arm at a second distal end thereof is connectable by a second distal joint to the other of the pair of mooring lines, wherein the first coupler is arranged as a first uni-joint between the first end of the elongated yoke plate and the first lever arm, and the second coupler is arranged as a second uni-joint between the second end of the elongated yoke plate and the second lever arm.

2. The yoke plate assembly according to claim 1, wherein the articulation is selected from a group consisting of: a one-axis joint, a two-axis joint, a gimbal joint, and a rotary joint.

3. The yoke plate assembly according to claim 2, wherein the first and second couplers are uni-joints with coplanar axes.

4. The yoke plate assembly according to claim 1, wherein the first and second couplers are uni-joints with coplanar axes.

5. The yoke plate assembly according to claim 4, wherein the first and second lever arms each comprise a rod and a receptacle part for receiving and forming a disconnectable connection with the rod, each receptacle being connected to a respective one of the first and second couplers on the first end of the elongated yoke plate and the second end of the elongated yoke plate, respectively.

6. The yoke plate assembly according to claim 1, further comprising:

a stopper mechanism that limits an inclination angle of the elongated yoke plate relative to a surface plane of the assembly plate up to a predetermined maximum angle value.

7. The yoke plate assembly according to claim 1, wherein the yoke plate assembly is configured to have the yoke plate set under an inclination angle with respect to the floating object in such a manner that the articulation is tilted and the yoke plate aligned with the inclination of the mooring line.

8. The yoke plate according to of claim 7, wherein the inclination angle is not substantially vertical.

9. A method of mooring a floating object in a body of water by means of first and second mooring lines, comprising providing the yoke plate assembly in accordance with claim 1, providing the first and second mooring lines, connecting the first distal joint to the first mooring line, and connecting the second distal joint to the second mooring line.

10. The yoke plate assembly according to claim 1, wherein the articulation is selected from a group consisting of: a one-axis joint, a two-axis joint, a gimbal joint, and a rotary joint.

11. A mooring arrangement for mooring a floating object in a body of water by means of at least a pair of mooring lines attached to the floating object, the arrangement comprising:

an anchor body; and a yoke plate assembly, the yoke plate assembly including an assembly plate for mechanically coupling to the anchor body, an elongated yoke plate with a center that is pivotally connected to the assembly plate by means of an articulation, a first lever arm having a first proximal end connected by a first coupler to a first end of the elongated yoke plate, a second lever arm having a second proximal end connected by a second coupler to a second end of the elongated yoke plate longitudinally opposite to the first end, the first coupler arranged as a first uni-joint between the first end of the elongated yoke plate and the first lever arm, and the second coupler arranged as a second uni-joint between the second end of the elongated yoke plate and the second lever arm, wherein during mooring the first lever arm at a first distal end thereof is connected by a first distal joint to a first one of the pair of mooring lines, the second lever arm at a second distal end thereof is connected by a second distal joint to a second one of the pair of mooring lines, the yoke plate assembly is connected to the anchor body, and the anchor body is placed at a bed of the body of water.

12. The mooring arrangement according to claim 11, wherein during use each of the mooring lines is tensioned and taut.

13. A floating object configured to be moored to a bed of a body of water by a mooring arrangement, comprising:

an anchor body;

a yoke plate assembly; and a pair of mooring lines, the yoke plate assembly including an assembly plate for mechanically coupling to the anchor body, an elongated yoke plate with a center pivotally connected to the assembly plate by means of an articulation, a first lever arm having a first proximal end connected by a first coupler to a first end of the elongated yoke plate, and a second lever arm having a second proximal end connected by a second coupler to a second end of the elongated yoke plate longitudinally opposite to the first end, wherein the first coupler is arranged as a first uni-joint between the first end of the elongated yoke plate and the first lever arm, and the second coupler is arranged as a second uni-joint between the second end of the elongated yoke plate and the second lever arm, the first lever arm at a first distal end thereof is connected by a first distal joint to a first one of the pair of mooring lines, the second lever arm at a second distal end thereof is connected by a second distal joint to a second one of the pair of mooring lines, the yoke plate assembly connected to the anchor body, the anchor body placed at a bed of the body of water, and the pair of mooring lines each attached to the floating object.

14. The floating object according to claim 13, wherein each of the mooring lines is tensioned and taut, and the floating object is at least partially submersed by the tensioned mooring lines, relative to a level of the floating object floating free.

15. The floating object according to claim 13, wherein the floating object is a tension leg platform (TLP) floating support structure wherein the pair of mooring lines form a tension leg of the floating support structure.

* * * * *